US005628563A

United States Patent [19]

Fisher

[11] Patent Number: 5,628,563

[45] Date of Patent: May 13, 1997

[54] METHOD AND SYSTEM FOR SLURRY PREPARATION AND DISTRIBUTION

[75] Inventor: Donald S. Fisher, Visalia, Calif.

[73] Assignee: Montague/Fisher, Inc., Visalia, Calif.

[21] Appl. No.: 552,892

[22] Filed: Nov. 3, 1995

[51] Int. Cl.[6] ..... B01F 5/12

[52] U.S. Cl. ..... 366/270; 366/327.1

[58] Field of Search ..... 366/262, 263, 366/264, 265, 270, 279, 302, 325.1, 326.1, 330.1, 152.1, 152.2, 162.1, 327.3, 327.1, 327.4

[56] References Cited

U.S. PATENT DOCUMENTS

| | | | |
|---|---|---|---|
| 721,974 | 3/1903 | Smith | 366/270 |
| 1,592,713 | 7/1926 | Bendixen | 366/270 |
| 1,911,644 | 5/1933 | Overbury | 366/270 |
| 3,365,176 | 1/1968 | Christensen | 366/327.4 |
| 4,812,045 | 3/1989 | Rivers . | |
| 4,820,053 | 4/1989 | Rivers . | |

*Primary Examiner*—Robert W. Jenkins

*Attorney, Agent, or Firm*—Graham & James LLP

[57] ABSTRACT

A method and apparatus for supplying gypsum slurry of predetermined concentration to a follow-on utilization device, such as an irrigation network. Slurry of a first higher concentration is prepared in a vessel using a vertically arranged mixer with power and drive components mounted outside the tank and a mixer shaft bearing an impeller and a propeller positioned inside the tank for immersion in the slurry ingredients. Rotation of the impeller and propeller causes the slurry ingredients to flow downwardly in the central region of the vessel, outwardly near the bottom towards the inner wall surfaces, upwardly of the inner wall surfaces towards the top and inwardly to the central region in a cyclic fashion to produce a uniform slurry. The slurry is withdrawn through an outlet in one of the tank walls and mixed with externally supplied water in a mixing chamber to dilute the slurry to a desired useable concentration. The added water is supplied via an adjustable flow meter to obtain the desired diluted concentration. Once the diluted concentration has been selected, a uniform concentration is maintained throughout the delivery cycle, regardless of the level of the slurry in the vessel.

17 Claims, 4 Drawing Sheets

METHOD AND SYSTEM FOR SLURRY PREPARATION AND DISTRIBUTION

BACKGROUND OF THE INVENTION

This invention relates to water amendment technology in general. More particularly, this invention relates to methods and systems for combining a mixed component in the form of a slurry with water so as to effect remediation of the water for some utilization purpose, such as to affect soil conditions using an irrigation network.

Methods and systems are known for combining make-up water with gypsum in order to provide a slurry of predetermined initial starting concentration for the purpose of affecting soil conditions. In a typical application, a measured amount of powdered gypsum is mixed with a known volume of make-up water in order to provide a slurry of preselected initial density, depending upon the calculated soil remediation requirements, the mixture being prepared in a holding tank of special design located adjacent the inlet to an irrigation facility. The slurry mixture is then pumped from the tank to the inlet of the irrigation system, adding fresh make-up water to the tank as the slurry level in the tank drops below a predetermined minimum level. The slurry mixture in the tank is agitated continuously during the withdrawal process in order to maintain a uniform suspension of gypsum particles in water.

Known slurry make-up and distribution systems suffer from a number of disadvantages. Firstly, the agitation mechanisms used in most tanks are disposed within the tank itself, typically in a horizontal attitude. With slurry in the tank above the level of the agitator, the bearings used to mount the agitator shaft for rotation are physically contacted by the slurry mixture, which is highly abrasive to most bearing materials. As a consequence, the agitator bearings are prone to premature failure and require costly replacement. In addition, the mounting of the agitator is typically done through the end or side walls of the tank, which places large mechanical loads on these walls. The walls must thus either be reinforced at additional cost to resist these forces, or will be subject to premature failure in a form of cracking or bending.

Another disadvantage with known slurry tank configurations lies in the use of additional make-up water when the slurry level drops below a predetermined lower threshold. When additional make-up water is added to the existing slurry mixture in the tank, the density of the slurry changes. Unless this change can somehow be compensated for, the efficacy of the soil treatment is impaired and the optimum desired soil effect will never be attained. In some cases, it is possible to partially counter the effective slurry dilution by simply carrying on the slurry treatment for a longer period of time: however, at best, this adds additional water cost to the soil treatment process and, at worst, does not result in the proper amount of calcium irrigated into the soil.

Efforts to date to provide a slurry tank based soil conditioning system devoid of the above disadvantages have not met with success.

SUMMARY OF THE INVENTION

The invention comprises a method and system for providing a soil treatment slurry to an irrigation system which ensures linear slurry flow and a constant level of treatment regardless of the amount of slurry in the vessel, and which employs a slurry agitation technique which provides uniform particle suspension in the slurry but which produces no mechanical thrust forces on the tank side or end walls and requires no bearing immersion in the slurry within the tank.

From a process standpoint, the invention comprises a method of preparing a slurry mixture for distribution to an outlet, the method including the steps of filling a vessel with a desired amount of water, placing a desired amount of particulate material in the vessel, mixing the particulate material and water by drawing the ingredients downwardly in the central region of the vessel, pushing the ingredients outwardly from the central region to the periphery of the vessel, and permitting the ingredients to flow upwardly along the periphery of the vessel and inwardly to the central region; and continuing the mixing step until a substantially uniform slurry is obtained.

The step of drawing the ingredients downwardly is preferably performed with an impeller mounted for rotation about an axis passing through the central region of the vessel, and the step of pushing the ingredients outwardly from the central region to the periphery of the vessel is preferably performed with a propeller mounted for rotation about the same axis as the impeller and located below the impeller closer to the bottom of the vessel.

Once the slurry has been prepared in the vessel, the method proceeds by withdrawing the slurry from the vessel, adding a desired amount of water to the slurry withdrawn from the vessel to produce a diluted slurry of preselected density, and permitting the diluted slurry to flow to an outlet.

The step of adding a desired amount of water is preferably performed in a mixing chamber located externally of the vessel. The step of adding also includes the steps of supplying water to the inlet of a flow meter and supplying the water flowing through the flow meter to the mixing chamber; and the step of adding further includes adjusting the rate of flow of water through the flow meter to the desired amount.

From an apparatus standpoint, the invention comprises a slurry preparation and distribution apparatus which comprises a vessel for containing water and particulate material forming the slurry ingredients, the vessel having an interior defined by a bottom, side walls and a top. Slurry mixing means are mounted to the top of the vessel, and include a motor, a gear driven mechanism coupled to the motor and a mixing shaft coupled to the gear drive mechanism. The motor and drive gear mechanism are located substantially outside the interior of the vessel so as not to contact any slurry contained within the vessel.

The mixing shaft is located centrally within the interior of the vessel and is oriented generally along an axis substantially normal to the bottom of the vessel.

The slurry mixing means further includes an impeller secured to the mixing shaft at a first location and a propeller secured to the mixing shaft at a second location below the first location and closer to the bottom of the tank than the impeller so that rotation of the impeller and propeller causes the slurry ingredients to flow downwardly in the central interior region of the vessel, outwardly generally along the bottom thereof to the side walls, upwardly of the side walls towards the top of the vessel and inwardly towards the central interior region.

A slurry outlet is arranged in one of the side walls of the vessel, and a mixing chamber having a first inlet coupled to the slurry outlet receives slurry of a first concentration from the vessel interior. The mixing chamber has a second inlet coupled to a water supply means for supplying water to the mixing chamber to dilute the slurry to a second concentration. The water supplying means preferably comprises a flow meter which regulates the flow rate of the dilution water to the mixing chamber. A pump has an inlet coupled to an outlet of the mixing chamber for receiving the slurry diluted to a second concentration, and an outlet for supplying the diluted slurry to a follow-on utilization device, such as an irrigation distribution network.

For a fuller understanding of the nature and advantages of the invention, reference should be made to the ensuing detailed description, taken in conjunction with the accompanying drawings.

DETAILED DESCRIPTION OF THE PREFERRED EMBODIMENTS

Figure 1:
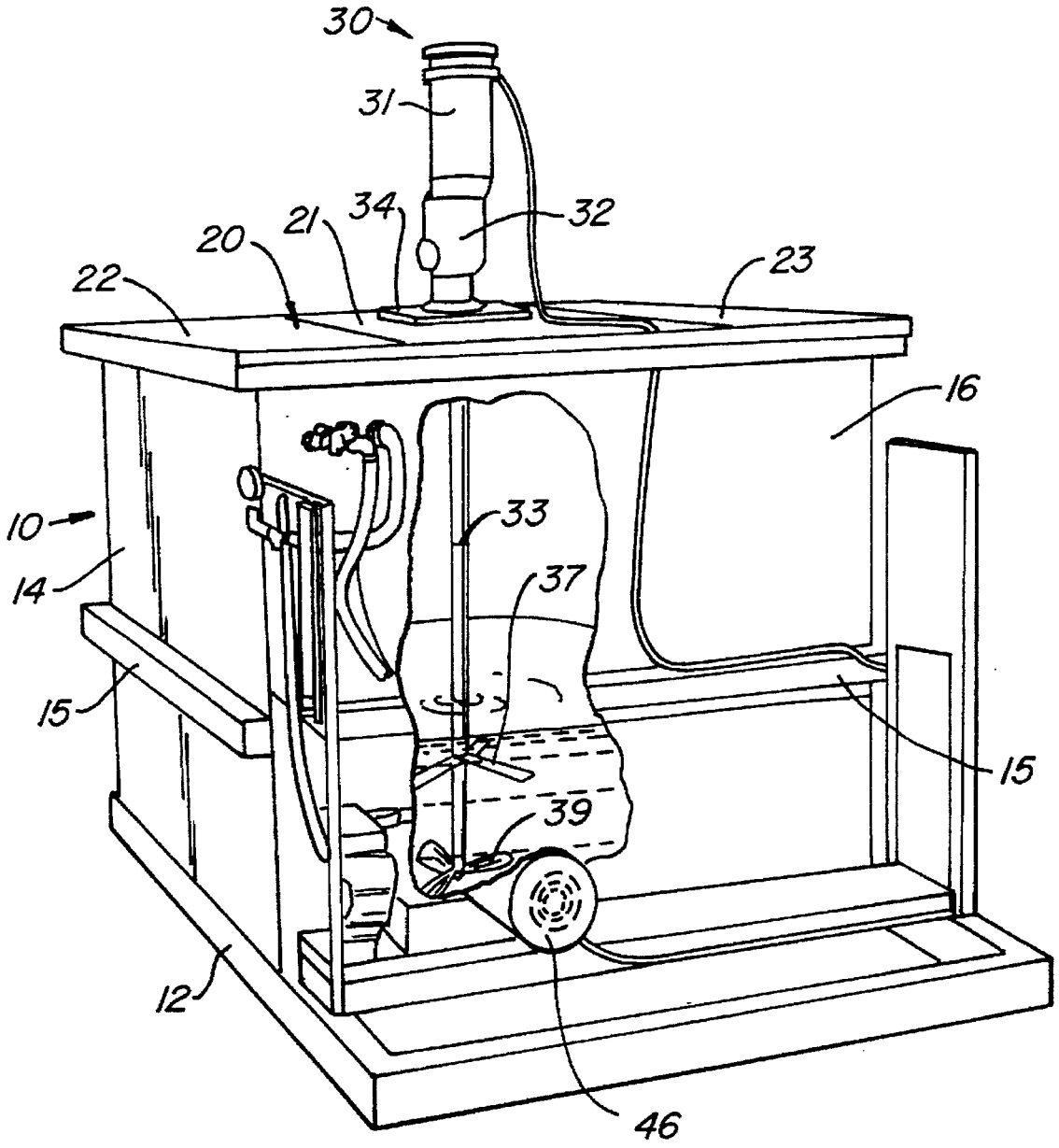
FIG. 1 is a perspective view partially broken away of a preferred embodiment of the invention.

Turning now to the drawings, FIGS. 1–4 illustrate a preferred embodiment of the invention designed for use in a soil application in which a gypsum slurry of predetermined density is metered at a linear flow rate to an irrigation network. As seen in these figures, a slurry tank generally designated with reference numeral 10 is mounted on an appropriate base 12. Tank 10 has a plurality of side walls, two of which are visible in the figures (walls 14, 16). Tank 10 is also provided with an enclosing bottom leading to an external drain valve 17 (FIG. 4), which is used to drain the interior of tank 10 for maintenance purposes.

Tank 10 is provided with a top generally designated with reference numeral 20 having a fixed central portion 21 and a pair of removable flanking portions 22, 23 which are arranged to provide access to the interior of tank 10, either by means of hinges, fasteners or some other equivalent arrangement. Access to the interior of tank 10 is required for the purpose of placing powdered gypsum into the tank and for inspection and maintenance purposes.

Tank 10 is also provided with a strengthening rib 15 around the outside thereof and consisting of a plurality of individual rib sections 15 mounted horizontally as shown. Tank 10 may be fabricated from any material which is compatible with the slurry to be contained therein. For a gypsum slurry, both fiberglass and stainless steel are suitable choices for the tank 10 material.

Mounted to fixed central portion 21 of tank top 20 is a vertical mixing assembly generally designated with reference numeral 30. Vertical mixing assembly 30 includes a motor portion 31, a gear drive portion 32 and a mixer shaft 33. All bearings required for mixing assembly 30 are located externally of the tank 10 interior within portions 31 and 32 and consequently never contact the slurry within tank 10. Mixing assembly 30 is secured to central top portion 21 by means of a flange portion 34 and suitable mounting bolts 35 (FIG. 4).

Secured to mixer shaft 33 at a first level within tank 10 is an impeller 37. Impeller 37 is preferable a stainless steel impeller and is secured to mixer shaft 33 in any suitable manner. Secured at a lower level to mixer shaft 33 is a propeller 39, also preferably fabricated from stainless steel. Vertical mixer assembly 30 is preferably a BGMF series mixer available from Brawn Mixer, Inc. of Holland, Mich.

Figure 4:
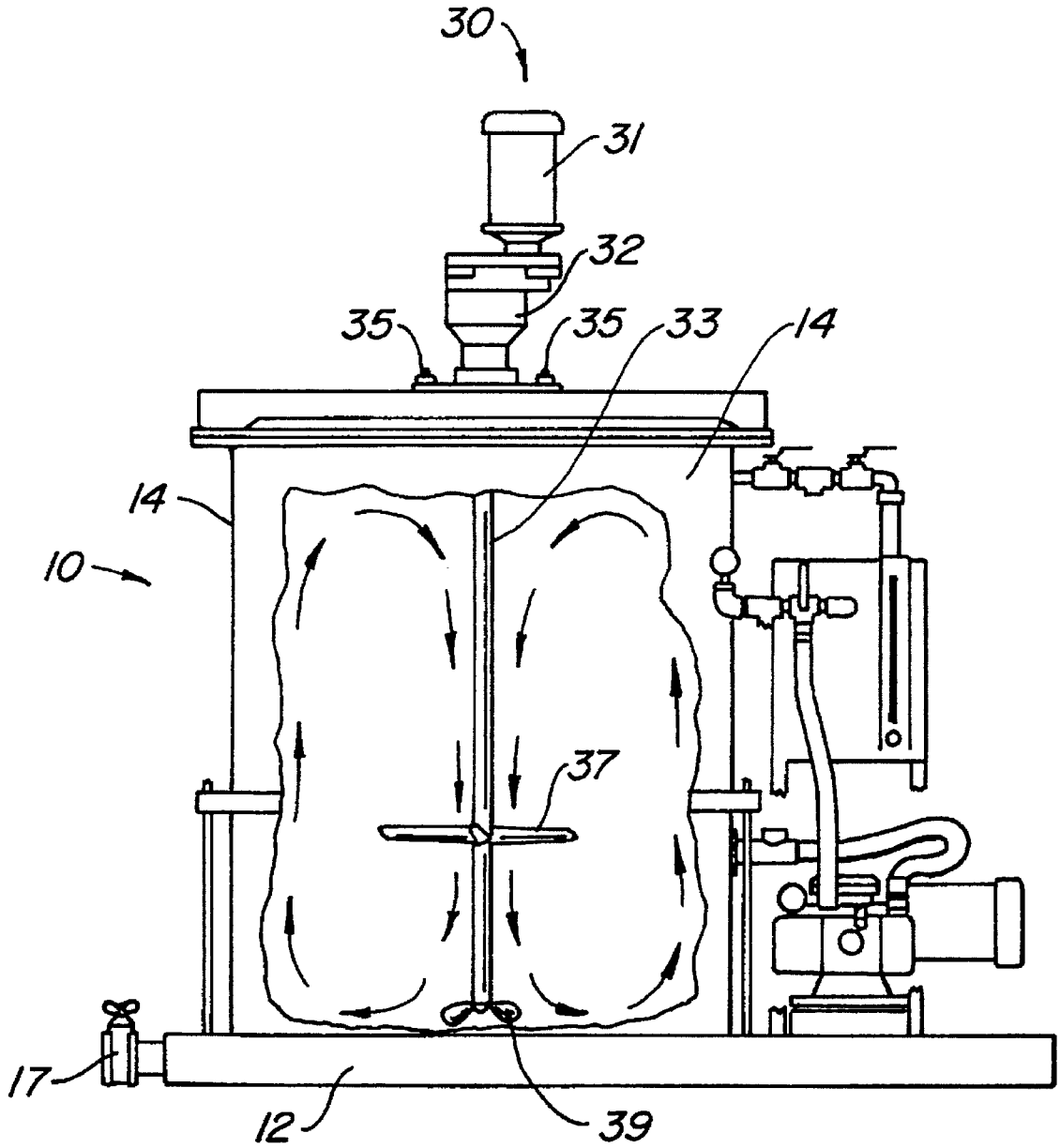
FIG. 4 is a schematic diagram illustrating slurry flow within the vessel.

As best shown in FIG. 4, when shaft 33 is rotated by the motor 31 via the gear drive mechanism 32, slurry within the interior of tank 10 is drawn downwards in the central region influenced by the impeller 37 and is pushed radially outwardly near the tank bottom by propeller 39. The slurry then follows the upward path depicted by the arrows in FIG. 4 along the inside surface of the tank walls 14 and then returns to the central region to be drawn downwardly again. The combined action of the downward pull of the impeller 37 and the radial push of the propeller 39 ensures thorough agitation of the slurry mixture and continuous suspension of the solids in the water, which is highly important in maintaining a slurry of preselected uniform density. As noted above, the materials used in the construction of tank 10 must be suitable for the nature of the slurry contained therein. For a gypsum slurry, the materials must possess inert properties in order to resist the corrosive nature of gypsum. Materials suitable for this purpose are fiberglass and stainless steel of appropriate thickness in order to resist pressures created on the tank walls 14 by high density slurries.

Figure 5:
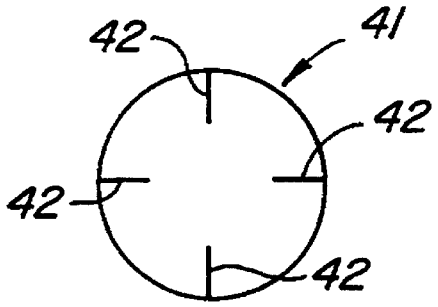
FIG. 5 is a top sectional view of an alternate tank shape.

It should be noted that the performance of the mixing process is affected by the shape of tank 10. The only cross-sectional shapes found acceptable to date are a square tank, and a round tank 41 illustrated in FIG. 5 having four baffles 42 arranged at an angle of 90 degrees to each other. These two shapes enable the desired slurry motion illustrated in FIG. 4 to be achieved: viz. the suspended material rolls up the walls of the tank and down the central axis of the mixer shaft 33 to create thorough, complete mixing of the water and particulate materials within the tank 10.

Control of the make-up water and the slurry flow, as well as dilution of the slurry to an appropriate output level is effected by a plurality of valves and conduits to be described, a pump 45, a motor 46 and gear reduction unit 48 having an input shaft (not shown) coupled to the output shaft of the motor 46 and an output shaft (not shown) coupled to the driving input of the pump 45. In the preferred embodiment, pump 45 comprises a Model 9910-D30 positive displacement diaphragm pump available from Hypro Corporation of New Brighton, Minn. Pump 45 is driven at a constant RPM by means of gear reduction unit 48, which in the preferred embodiment comprises a ten-to-one or five-to-one Model D-90 type SE speed reducer available from Peerless. Winsmith, Inc. of Springville, N.Y. Motor 46 is a single or three-phase three-quarter or one-and-one-half horsepower electric motor available from a variety of sources.

Figure 2:
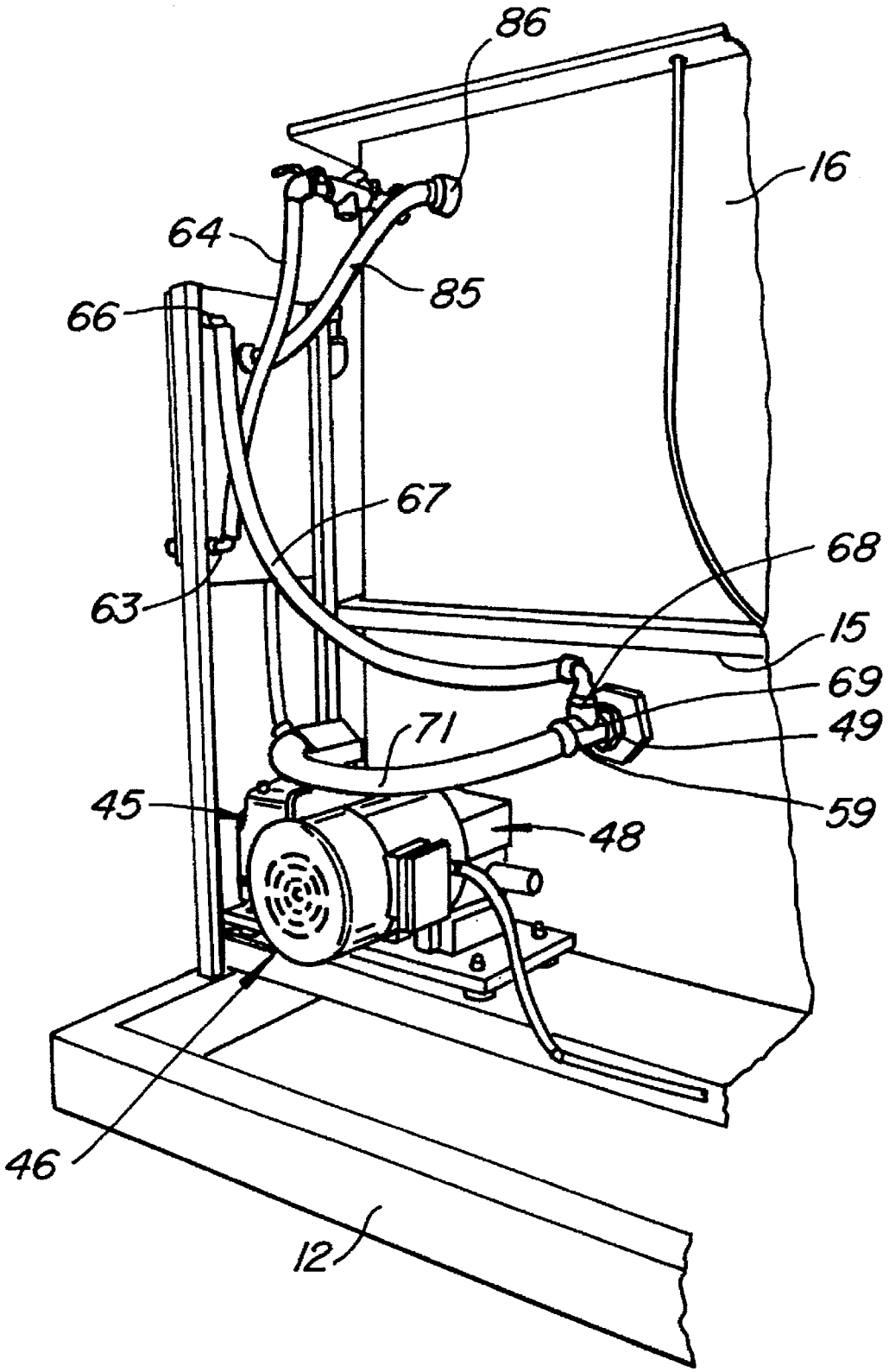
FIG. 2 is a partial perspective view of the FIG. 1 embodiment illustrating the pump motor, slurry tank outlet and mixing chamber and the back of the flow meter panel.
Figure 3:
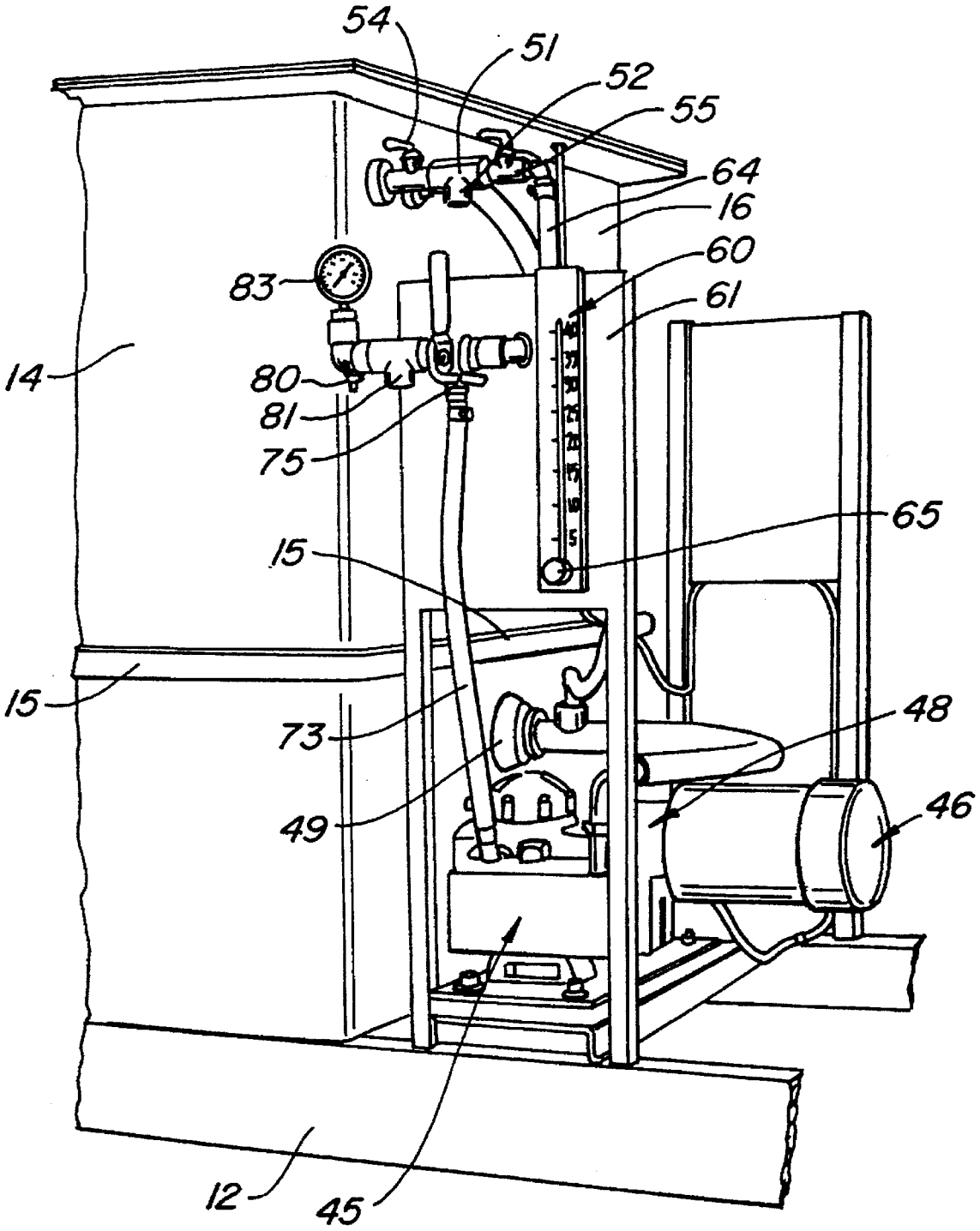
FIG. 3 is a partial perspective view of the embodiment of FIG. 1 illustrating the flow meter panel and adjustment valves.

As best seen in FIGS. 2 and 3, make-up water is supplied from a suitable source to a T-fitting 51 having a water inlet 52. A first inlet valve 54 is coupled between one end of tee 51 and the interior of tank 10. To fill the interior of tank 10 to the appropriate make-up water level, valve 54 is opened with water supplied to inlet 51. After tank 10 has been filled to the appropriate water level, vertical mixing assembly 30 is initially operated for an appropriate period of time with gypsum in order to create a uniform gypsum slurry. In the preferred embodiment, an initial mixing period of ten minutes is required to prepare the slurry for dispensation. It is noted that the flow of slurry within tank 10 is in the range of from about 2100 gallons per minute to about 2900 gallon per minute, depending on the tank volume, using the vertical mixing assembly described above.

Once prepared for dispensation, the slurry is withdrawn from tank 10 while continuously operating mixing assembly 30 to maintain the gypsum suspension in the water. Slurry flows from tank 10 to an external mixing chamber 59 where intake water is admixed with the concentrated slurry in order to dilute the slurry to a desired density value. For this purpose, a flow meter 60 is mounted on a control panel 61. Flow meter 60 is preferably a unit sold under the trademark RATEMASTER by Dwyer Instruments, Inc. of Michigan City, Ind. Intake water is supplied to an inlet 63 at the bottom of flow meter 60 via a valve 55 secured to the tee 51 at the end opposite from valve 54, and a flexible conduit 64. After passing upwardly through flow meter 60, the water exits via outlet 66 and flows through a flexible conduit 67 to an inlet 68 of mixing chamber 59. An outlet 69 of mixing chamber 59 is coupled via a conduit 71 to the inlet of pump 45. Diluted slurry exiting from pump 45 is coupled via a conduit 73 to an inlet of a diverter valve 75. One side of valve 75 is coupled to a T-fitting 80 having a slurry outlet 81. A pressure gauge 83 is attached to the remaining inlet of T-fitting 80. The other end of diverter valve 75 is coupled to a conduit 85, which is connected to a fitting 86 leading back into the upper interior of tank 10.

In operation, with motor 46 energized, pump 45 draws slurry through tank outlet 49 into mixing chamber 59 where the concentrated slurry is mixed with intake water supplied through flow meter 60. The amount of intake water mixed with the concentrated slurry is selected by adjusting a needle valve (not shown) within flow meter 60 using an adjustment knob 65. To assist the operator, flow meter 60 has a metering scale shown in FIG. 3 marked in gallons per minute. The diluted slurry exiting from the external mixing chamber 59 flows through pump 45 upwardly through conduit 73 to diverter valve 75. Depending on the setting of valve 75, the diluted slurry either exits via outlet 81 to the follow-on irrigation distribution network or is diverted back into the interior of tank 14. It should be noted, that the return flow path just described is not employed during active distribution periods when diluted slurry is being fed to the follow-on irrigation distribution network.

In order to prevent large chaff and other debris from entering the flow outlet of tank 10, a screen grid (not illustrated) is normally provided inside tank 10 near the bottom and coveting the inlet to the flow outlet conduit. Good results have been obtained using a #16 stainless steel grid screen. Other size screens may be employed, as desired.

As will now be apparent, the invention affords a number of advantages over known slurry make-up and distribution tank installations. Firstly, the vertical mixing assembly 30 and tank 10 configuration ensures that a uniform, thoroughly dispersed slurry of gypsum in water can be quickly established and maintained for any desired period of time. In addition, since all bearing and gear components of the vertical mixing assembly 30 are mounted externally of tank 10, mechanical degradation of the bearings and gear components by the slurry is entirely avoided, which prolongs the life of these components. Still further, since the mechanical stresses due to loading and operation of the assembly 30 are taken up by the center top section 21 of the tank top 20, there are no forces on the bearing side walls 14, 16 of the tank 10 imposed by the mixing apparatus. Consequently, the problem of flexing, bending and cracking of the side walls of the tank encountered in prior art systems is entirely avoided. In addition, once the desired level of slurry dilution is selected by the adjustment of the flow meter using knob 65, the density of the slurry exiting from outlet 81 is essentially invariant as the amount of slurry in tank 10 is withdrawn. This important advantage ensures that the desired concentration of slurry constituents are uniformly distributed over the treatment period through the irrigation distribution network. Stated differently, there is no change in slurry density over the entire pumping cycle. Lastly, due to the relative simplicity of the design and layout of the various system components, the invention can be quickly installed and be made operational with a minimum of technical expertise, and maintenance of the system is relatively easy to perform.

Physical embodiments of the invention have been constructed using square cross-section tanks 10 and with a tank capacity of 2000 pounds of gypsum and 4000 pounds of gypsum, respectively. The slurry density in the tank has been maintained at 9.3 pounds per gallon for the smaller embodiment and 9.5 pounds per gallon in the larger embodiment. In the smaller embodiment, the motor 31 used for the mixer assembly 30 is a one-half horsepower motor, while a three-quarter horsepower motor has been used in the larger embodiment. The pump motor 46 and pump 45 are the units identified above. For the one ton capacity mixer the range on outputs is as follows:

| pump pressure psi | flow gal/min | flow lbs/min |
|---|---|---|
| 50 | 5.9 | 54.8 |
| 100 | 5.8 | 53.9 |
| 200 | 5.6 | 52.0 |
| 300 | 5.4 | 50.2 |

For the two ton mixer embodiment, the following specification supply:

| pump pressure psi | flow gal/min | flow lbs/min |
|---|---|---|
| 50 | 5.9 | 56.0 |
| 100 | 5.8 | 55.1 |
| 200 | 5.6 | 53.2 |
| 300 | 5.4 | 51.3 |

While the above provides a full and complete disclosure of the preferred embodiments of the invention, various modifications, alternate constructions and equivalents may be employed, as desired. For example, while valves 54, 55 and 75 have been shown and described as manually operated valves, electrically operated valves may be employed along with an appropriate control circuit for controlling the settings of each valve individually. Moreover, motors and pumps having other capacities and ratings may be employed, as well as other materials for the construction of tank 10. Further, while two specific examples of tank 10 capacities have been described, other sizes may be employed up to a potential practical size of twenty tons capacity. In addition, while the invention has been described with express reference to a gypsum slurry mixing and distribution application, other applications of the invention may occur to those skilled in the art. Therefore, the above description and illustrations should not be construed as limiting the scope of the invention, which is defined by the appended claims.

What is claimed is:

1. A method of preparing a substantially uniform slurry mixture for distribution to a utilization site, said method comprising the steps of:

(a) providing a vessel having a plurality of substantially planar vertically oriented flow surfaces;

(b) filling the vessel with a desired amount of water;

(c) placing a desired amount of particulate material in the vessel;

(d) mixing the particulate material and water by (i) drawing the ingredients substantially exclusively downwardly in the central region of the vessel, (ii) pushing the ingredients outwardly from the central region along the bottom of the vessel to the inner periphery thereof, and (iii) permitting the ingredients to flow upwardly along the substantially planar vertically oriented flow surfaces of the vessel and inwardly to the central region; and (e) continuing the mixing step (d) until the substantially uniform slurry is obtained and during subsequent distribution.

2. The method of claim 1 wherein said step (i) of drawing is performed with an impeller mounted for rotation about an axis passing through the central region of the vessel.

3. The method of claim 1 wherein said step (ii) of pushing is performed with a propeller mounted for rotation about an axis passing through the central region of the vessel.

4. The method of claim 1 wherein said step (i) of drawing is performed with an impeller mounted for rotation about an axis passing through the central region of the vessel; and wherein said step (ii) of pushing is performed with a propeller mounted for rotation below the impeller and about the same axis.

5. A method of delivering a slurry of predetermined density to a utilization outlet, said method comprising the steps of:

(a) preparing a concentrated slurry of predetermined substantially uniform density in a vessel from a predetermined quantity of water and particulate material;

(b) withdrawing the concentrated slurry from the vessel;

(c) adding a desired amount of water to the concentrated slurry withdrawn from the vessel to produce a diluted slurry of predetermined density; and (d) permitting the diluted slurry to flow to the utilization outlet.

6. The method of claim 5 wherein said step (c) of adding is performed in a mixing chamber located externally of the vessel.

7. The method of claim 5 wherein said step (c) of adding includes the steps of supplying water to the inlet of a flow meter and supplying the water flowing through the flow meter to the mixing chamber.

8. The method of claim 7 wherein said step (c) of adding further includes the step of adjusting the rate of flow of water through the flow meter to the amount required to produce the diluted slurry of predetermined density.

9. A slurry preparation and distribution apparatus comprising:

a vessel for containing water and particulate material forming the slurry ingredients, said vessel having an interior defined by a bottom, side walls and a top;

slurry mixing means mounted to said top of said vessel, said slurry mixing means including a motor, a gear drive mechanism coupled to said motor, and a mixing shaft coupled to said gear drive mechanism, said motor and said gear drive mechanism being located substantially outside said interior of said vessel so as not to contact any slurry contained within said vessel, said mixing shaft being oriented generally along an axis substantially normal to said bottom of said vessel and centrally of said interior of said vessel, said slurry mixing means further including an impeller secured to said mixing shaft at a first location and a propeller secured to said mixing shaft at a second location below said first location and closer to said bottom of said tank than said impeller so that rotation of said impeller and propeller causes the slurry ingredients to flow downwardly in the central interior region of said vessel, outwardly generally along the bottom thereof to said side walls, upwardly of said side walls towards said top of said vessel and inwardly towards said central interior region;

a slurry outlet arranged in one of said side walls of said vessel;

a mixing chamber having a first inlet coupled to said slurry outlet for receiving slurry of a first concentration from said vessel interior, a second inlet and an outlet;

means coupled to said second inlet for supplying water to said mixing chamber to dilute the slurry to a second concentration; and a pump having an inlet coupled to said mixing chamber outlet for receiving the slurry diluted to said second concentration and an outlet for supplying said diluted slurry to a follow-on utilization apparatus.

10. The apparatus of claim 9 wherein said vessel has a substantially square cross-sectional configuration.

11. The apparatus of claim 9 wherein said vessel has a substantially circular cross-sectional configuration with vertically extending baffles arranged at substantial mutual right angles.

12. The apparatus of claim 9 wherein said means for supplying water to said mixing chamber includes a flow meter for providing mixture water at a predetermined flow rate.

13. The apparatus of claim 12 wherein said flow meter is adjustable.

14. A method of preparing a substantially uniform slurry mixture for distribution to a utilization site, said method comprising the steps of:

(a) filling a vessel with a desired amount of water;

(b) placing a desired amount of particulate material in the vessel;

(c) mixing the particulate material and water by (i) drawing the ingredients downwardly in the central region of the vessel, (ii) pushing the ingredients outwardly from the central region along the bottom of the vessel to the inner periphery thereof, and (iii) permitting the ingredients to flow upwardly along the inner periphery of the vessel and inwardly to the central region;

(d) continuing the mixing step (c) until the substantially uniform slurry is obtained and during subsequent distribution;

(e) withdrawing the slurry from the vessel;

(f) adding a desired amount of water to the slurry withdrawn from the vessel to produce a diluted slurry of preselected density; and (g) providing the diluted slurry to the utilization site.

15. The method of claim 14 wherein said step (f) of adding is performed in a mixing chamber located externally of the vessel.

16. The method of claim 14 wherein said step (f) of adding includes the steps of supplying water to the inlet of a flow meter, and supplying the water flowing through the flow meter to the mixing chamber.

17. The method of claim 16 wherein said step (f) of adding further includes the step of adjusting the rate of flow of water through the flow meter to the desired mount.

* * * * *